United States Patent [19]

Östbo

[11] 4,178,880

[45] Dec. 18, 1979

[54] FURNACE

[76] Inventor: Nils Östbo, Volrat Thamsgatan 4, Göteborg, Sweden, 41278

[21] Appl. No.: 845,972

[22] Filed: Oct. 27, 1977

[30] Foreign Application Priority Data

| | | | |
|---|---|---|---|
| Nov. 11, 1976 | [SE] | Sweden | 7612550 |
| Nov. 11, 1976 | [SE] | Sweden | 7612551 |
| Nov. 11, 1976 | [SE] | Sweden | 7612552 |

[51] Int. Cl.[2] ..... F22B 7/12

[52] U.S. Cl. ..... 122/182 S

[58] Field of Search ..... 122/182 R, 182 S, 182 T, 122/149

[56] References Cited

U.S. PATENT DOCUMENTS

| | | | |
|---|---|---|---|
| 2,383,924 | 8/1945 | Way et al. | 122/182 |
| 2,554,092 | 5/1951 | DePoray | 122/182 |
| 2,568,781 | 9/1951 | Watts | 122/182 |
| 3,638,622 | 2/1972 | Ostbo | 122/182 |

*Primary Examiner*—Kenneth W. Sprague

*Attorney, Agent, or Firm*—Cantor and Singer

[57] ABSTRACT

A furnace comprising a fire tube and a final combustion chamber located axially downstream thereof is provided with a restricted passage between the fire tube and the final combustion chamber. The passage is located in a partition wall defining the inward end of the fire tube, and a number of grooves, being open towards the fire tube and directed tangentially with respect to an imaginary circle, inscribed within said passage, are formed in the sloping surface of said wall.

1 Claim, 2 Drawing Figures

FURNACE

BACKGROUND OF THE INVENTION

The present invention refers to a furnace comprising a fire tube, and a final combustion chamber located axially downstream of the fire tube, and in which a burner is mounted at the end of the fire tube remote from said chamber and a restricted passage is formed between the fire tube and the final combustion chamber, said passage being formed in a partition wall defining the inward end of the fire tube, the surface of said wall, presented towards the fire tube sloping towards said passage.

Such furnaces have fine combustion properties. The aim of the present invention is to simplify the design, and to further improve the combustion.

SUMMARY OF THE INVENTION

A furnace according to the invention is characterized in that a number of grooves, being open towards the fire tube, are formed in the sloping surface of the partition wall and are directed tangentially with respect to an imaginary circle, being inscribed within said passage.

The partition wall preferably includes a body of refractory material, adapted to be mounted in the fire tube, and the grooves are preferably formed with a cross sectional area, tapering in the direction from the envelope wall of the fire tube towards the passage.

DESCRIPTION OF A PREFERRED EMBODIMENT

Figure 1:
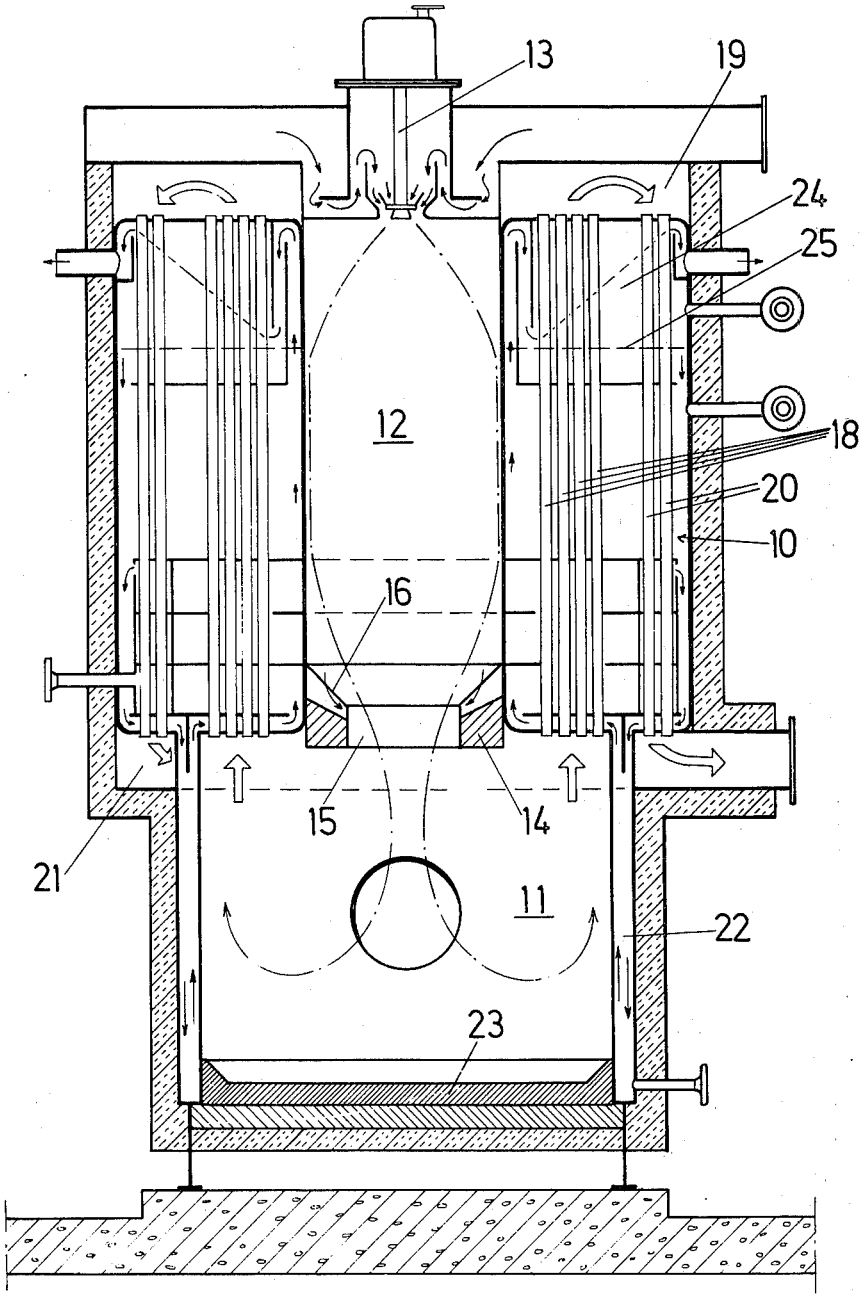
FIG. 1 is a vertical section through a steam boiler provided with a furnace according to the invention.
Figure 2:
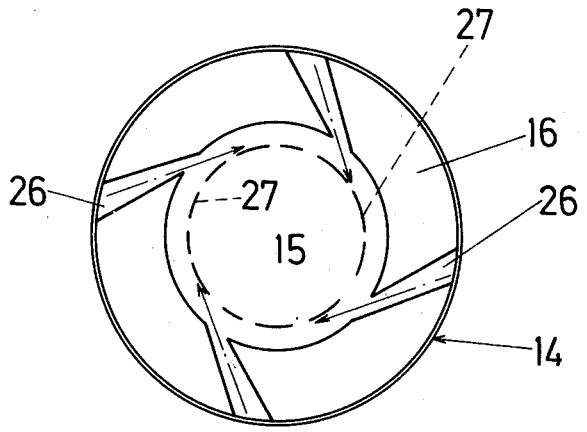
FIG. 2 shows the partition wall, as viewed from inside the fire tube.

The steam boiler shown in the drawings is of a basically well known type, and includes an upper, cylindrical portion 10 and a lower final combustion chamber 11. A fire tube 12 is fitted centrally within the upper portion, and is in its upper end provided with a burner 13. The lower end of the fire tube is defined by a wall formed by a body 14 of refractory material and having an outlet passage 15.

Those parts of the flame, which pass along the envelope wall of fire tube 12, will be cooled, so the combustion there will not be complete. Due to the shape of the top surface 16 of the refractory body 14, which slopes towards outlet passage 15, the peripheral parts of the flame will be forced into the core of the flame, immediately at the passage. An intense heating and a thorough mixing occurs, so an efficient final combustion is brought about in chamber 11.

The upper, cylindrical portion 10 includes a number of smoke tubes arranged in two concentric groups. The inward of these groups 18 extends between the final combustion chamber 11 and an upper turning chamber 19, while the outward group 10 of smoke tubes extends downwards from the latter to a lower collecting chamber 21, which is connected to a flue passage (not shown). The number of smoke tubes within each group is selected so the flow velocity of the gas, in spite of the reduced volume due to cooling, will be substantially the same.

The final combustion chamber 11 is outwardly defined by a water cooled wall 22, which is connected to the upper portion 10, intermediate the two groups 18 and 20 of smoke tubes. The bottom structure 23 of the final combustion chamber is here made of refractory material but may, in bigger, or highly loaded boilers also be water cooled.

The steam drum 24 is formed within the cylindrical portion 10, and will thus enclose the upper end of the fire tube. The water level during normal operation is denoted by 25.

Furnaces of above described type are known in the art, and have an acceptable combustion efficiency. The restricted passage has. however, been formed from plate material, included in the fire tube, or in the lower end plate of the cylindrical portion 10. respectively. In view of the intense heating at this part of the furnace, an efficient water cooling has been provided. To some extent this cooling counteracts the endeavour to raise the temperature of the gases having passed along the envelope wall of the fire tube. In order to improve the mixing of the gases, it has been suggested that guide plates should be fitted within the passage to increase the turbulence in the final combustion chamber 11. The cooling, as well as the guide plates, increase manufacturing costs.

According to the present invention the flame tube is formed with a smooth, cylindrical envelope wall, which is easily attached to the lower end plate of the upper portion. A body 14 of refractory material is fitted in the lower end of the fire tube, and forms an end wall thereof and includes passage 15. Depending upon the size of the furnace, the body may be formed as a unitary piece, or may be built up by means of suitably shaped tiles, or possibly cast in a mould.

Such a ceramic body will withstand very high temperatures, and it is a well known fact that ceramic inserts in a general way will improve the combustion properties.

One way of improving the combustion is to bring about a forceful turbulance. Guide plates, fitted into this intensely heated part of the furnace will soon be destroyed, and a high, initial efficiency will gradually be reduced.

Instead of separate guide plates the sloping surface 16 is provided with a number of grooves 26, being open towards the fire tubes. These grooves are directed tangentially with respect to an imaginary circle 27, being inscribed within passage 15.

These grooves will receive the on-flowing gases, deflect the same and direct them towards the passage. In order to increase the flow velocity within these partial flows, the grooves are designed so their cross sectional area tapers in the direction away from the envelope wall towards passage 15.

The direction of a part of the gas flow will thus be determined already before the entrance into the passage, and the pressure of the gases against the end wall will provide the necessary motive force. These partflows will be injected into the main flow within the passage proper, and will cause a forceful turbulence.

The drawing shows four grooves 26, but it is evident that the number of these grooves may vary depending upon the size of the ceramic body.

What I claim is:

1. In a vertical furnace comprising a smooth-walled fire tube and a final combustion chamber located axially downstream thereof, said fire tube having means for mounting a burner at its upper end remote from said final combustion chamber, (A) a partition wall including a body of refractory material, adapted to be mounted in the fire tube for separating said fire tube from said combustion chamber, said partition wall, towards the fire tube being defined by a smooth surface sloping towards its centre, (B) a restricted area passage, centrally located in said partition wall, and (C) a number of grooves, open towards the fire tube in said sloping surface and directed tangentially with respect to an imaginary circle, inscribed within said passage, said grooves being formed with a cross-sectional area, tapering in the direction from the smooth wall of the fire tube towards said passage to thereby increase the flow velocity of the on-flowing gases.

* * * * *